US007415228B2

(12) United States Patent
Kamimura

(10) Patent No.: US 7,415,228 B2
(45) Date of Patent: Aug. 19, 2008

(54) IMAGE-FORMING DEVICE HAVING A DRUM DRIVE GEAR FOR ENGAGING A DRUM GEAR

(75) Inventor: Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 308 days.

(21) Appl. No.: 11/318,598

(22) Filed: Dec. 28, 2005

(65) Prior Publication Data

US 2006/0140676 A1 Jun. 29, 2006

(30) Foreign Application Priority Data

Dec. 28, 2004 (JP) ..... 2004-381914

(51) Int. Cl.
*G03G 15/00* (2006.01)

(52) U.S. Cl. ..... 399/167

(58) Field of Classification Search ..... 399/107, 399/111, 116, 117, 159, 167
See application file for complete search history.

(56) References Cited

U.S. PATENT DOCUMENTS 5,930,562 A * 7/1999 Noda et al. ..... 399/114
6,901,229 B2 * 5/2005 Nishiuwatoko et al. ..... 399/167
7,010,246 B2 * 3/2006 Fujishiro et al. ..... 399/159
7,254,347 B2 * 8/2007 Matsumoto et al. ..... 399/13

FOREIGN PATENT DOCUMENTS

JP 9-179372 7/1997
JP 11-30893 2/1999

OTHER PUBLICATIONS

CN Office Action dtd Feb. 15, 2008, CN App 2005101381618.

* cited by examiner

*Primary Examiner*—Hoan H Tran
(74) *Attorney, Agent, or Firm*—Banner & Witcoff, Ltd.

(57) ABSTRACT

An image-forming device includes photosensitive drums, a drum gear, a drum gear rotating body, a drum drive gear, and a drum drive gear rotating body. The drum gear is provided on an axial end of each photosensitive drum. The drum gear rotating body is provided adjacent to the drum gear for rotating together with the drum gear. The drum drive gear is engaged with the drum gear and has the same number of gear teeth as the drum gear. The drum drive gear rotating body is provided adjacent to the drum drive gear at a position corresponding to the drum gear rotating body for rotating together with the drum drive gear. A protrusion is provided on a peripheral edge of the drum gear rotating body, and a depression is formed on a peripheral edge of the drum drive gear rotating body. The phase of the drum gear and the phase of the drum drive gear are aligned when the protrusion is fitted into the depression.

7 Claims, 8 Drawing Sheets

IMAGE-FORMING DEVICE HAVING A DRUM DRIVE GEAR FOR ENGAGING A DRUM GEAR

CROSS REFERENCE TO RELATED APPLICATION

This application claims priority to Japanese Patent Application No. 2004-381914 filed Dec. 28, 2004, the contents of which are hereby incorporated by reference into the present application.

TECHNICAL FIELD

The present invention relates to an image-forming device, and particularly to a tandem-type image-forming device.

BACKGROUND

In conventional tandem-type image-forming devices, it is difficult to manufacture the drum gears provided on the ends of the photosensitive drums and the drum drive gears disposed on the image-forming device side for driving the drum gears, without errors in shape or dimension. Such errors in the shape or dimension of the drum gear and drum drive gear cause the photosensitive drum, on which the drum gear is mounted, to rotate irregularly. When the image-forming device has a plurality of photosensitive drums, irregular rotations of the photosensitive drums may cause color registration problems in the image, resulting in a decline in image quality. Since the photosensitive drum is treated as a consumable that is discarded after use, the drum gear disposed on the photosensitive drum is normally formed of a resin material in order to minimize the manufacturing cost of the photosensitive drum. However, a resin gear is even more prone to errors in shape and dimension.

To resolve these problems, an image-forming device disclosed in Japanese Patent Application Publication No. HEI-11-30893 provides a worm wheel mounted on an end of each photosensitive drum. A mark is provided on part of the worm wheel. By detecting the mark with a sensor disposed near the rotating worm wheel, the image-forming device can control the rotational position, or phase, of the worm wheel.

However, the image-forming device described in Japanese Patent Application Publication No. HEI-11-30893 requires extra steps in the manufacturing process to form a mark on the worm wheel. This technology also requires extra space for the sensors and extra parts for supporting the sensors. Hence, the image-forming device has a complex structure in the engaging parts between the end of the photosensitive drum and the drum drive gear that drives the photosensitive drum, leading to a rise in the manufacturing cost of the image-forming device.

Another technology proposes to reduce this rise in cost by integrating the photosensitive drums for three colors and providing a photo interrupter and cam mechanism for the remaining photosensitive drum in order to align the phase of that photosensitive drum with the three integrated photosensitive drums.

However, this method requires that photosensitive drums for three colors be integrated. Therefore, when the image quality of a photosensitive drum for one color degrades and the drum must be replaced, the photosensitive drums for the other two colors whose image quality has not degraded must also be replaced, resulting in an unnecessary expense. Further, the drum drive gears mounted in the body of the image-forming device can be set to the same phase during assembly at the factory, and certainly the phase of the drum gears of the photosensitive drums that engage with the drum drive gears may also be set in phase at the factory. However, when the photosensitive drums are replaced with replacement parts, it is difficult to set the phase of the drum gear for the new photosensitive drum.

SUMMARY

In view of the foregoing, it is an object of the present invention to provide an image-forming device and a photosensitive drum unit used in the image-forming device having simple constructions while enabling the drum drive gear mounted in the body of the image-forming device to be always in phase with the drum gear on the photosensitive drum.

To achieve the above and other objects, the present invention provides an image-forming device including an outer frame, a drum gear, a drum gear rotating body, a drum drive gear, and a drum drive gear rotating body. The plurality of photosensitive drums disposed inside the outer frame. The drum gear is provided on an axial end of each photosensitive drum and is rotatable together with each photosensitive drum. The drum gear has gear teeth. The drum gear rotating body rotates together with the drum gear and has a peripheral surface provided with a protrusion.

The drum drive gear is drivingly rotatably supported on the outer frame and meshedly engaged with the drum gear. The drum drive gear has gear teeth having the same number of gear teeth as the drum gear. The drum drive gear rotating body is rotatable together with the drum drive gear. The drum drive gear rotating body has a peripheral surface in alignment with the peripheral surface of the drum gear rotating body and is formed with a depression engageable with the protrusion at a specific angular rotational phase of the drum gear and the drum drive gear. One of the drum gear and the drum drive gear is movable in a direction away from the other one of the drum gear and the drum drive gear when the protrusion rides up on the peripheral surface other than the depression of the drum drive gear rotating body, to disengage the drum gear from the drum drive gear and to stop rotation of the drum gear at an angular rotational phase of the drum gear and the drum drive gear other than the specific angular rotational phase.

In another aspect of the invention, there is provided an image-forming device including an outer frame, a drum gear, a drum gear rotating body, a drum drive gear, and a drum drive gear rotating body. The plurality of photosensitive drums is disposed inside the outer frame. The drum gear is provided on an axial end of each photosensitive drum and is rotatable together with each photosensitive drum. The drum gear has gear teeth. The drum gear rotating body rotates together with the drum gear and has a peripheral surface provided with a protrusion.

The drum drive gear is drivingly rotatably supported on the outer frame and meshedly engaged with the drum gear. The drum drive gear has the same number of gear teeth as the drum gear. The drum drive gear rotating body is rotatable together with the drum drive gear. The drum drive gear rotating body has a peripheral surface in alignment with the peripheral surface of the drum gear rotating body and is formed with a depression engageable with the protrusion at a specific angular rotational phase of the drum gear and the drum drive gear.

In another aspect of the invention, there is provided a photosensitive drum unit provided in an image-forming device including a plurality of photosensitive drums, a drum gear, and a drum gear rotating body. The drum gear is provided on an axial end of each photosensitive drum and rotates together with each photosensitive drum. The drum gear rotating body rotates together with the drum gear and has a peripheral surface provided with a protrusion.

DETAILED DESCRIPTION

Figure 1:
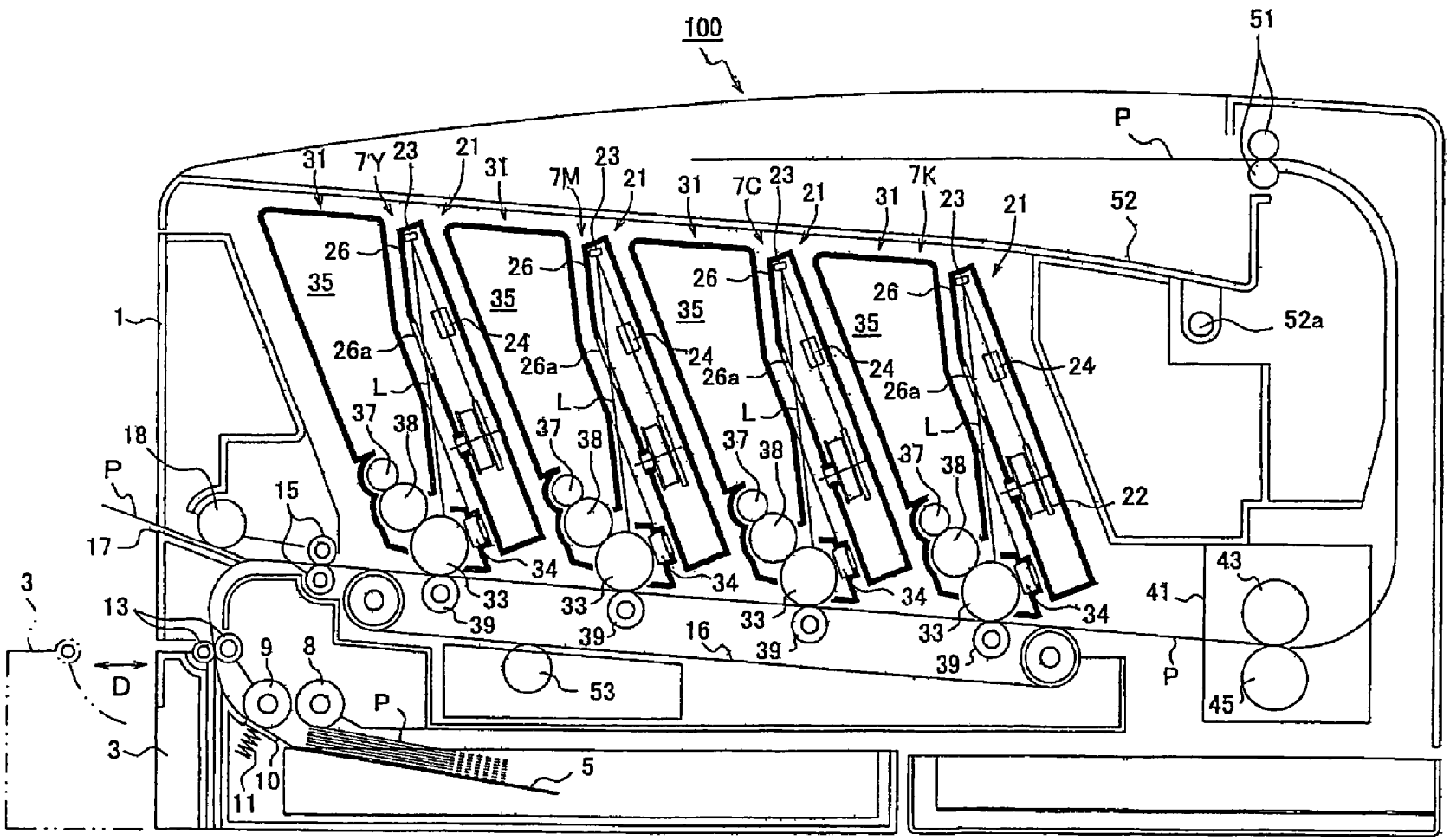
FIG. 1 is a side cross-sectional view showing the general structure of a color laser printer according to a preferred embodiment of the present invention.

A preferred embodiment of the present invention will be described with reference to FIG. 1. In the preferred embodiment, the image-forming device of the present invention is applied to a color laser printer. As shown in FIG. 1, a color laser printer 100 includes a main frame 1 as an outer casing, and a paper cassette 3 that can be detachably inserted below the main frame 1. The paper cassette 3 can be inserted or removed in a horizontal direction indicated by the arrows D. In FIG. 1, the solid lines show the paper cassette 3 in a mounted position, and the broken line shows the paper cassette 3 being pulled from the mounted position toward a removal position. When the paper cassette 3 is pulled out to the removal position, the user can replenish the paper cassette 3 with a recording paper P as desired.

A support plate 5 is provided in the paper cassette 3 for supporting the recording paper P stacked therein. A spring (not shown) urges the support plate 5 (and the recording paper P supported on the support plate 5) upward. A pair of feeding rollers 8 and 9 is disposed above the support plate 5 for separating and supplying the recording paper P stacked on the support plate 5 one sheet at a time to image-forming units 7Y, 7M, 7C, and 7K (hereinafter also collectively referred to as image-forming units 7) described later. The feeding roller 8 disposed to the right of the feeding roller 9 in FIG. 1 picks up and supplies the topmost sheet of recording paper P to the feeding roller 9. The feeding roller 9 disposed to the left of the feeding roller 8 in FIG. 1 functions as a pickup roller for separating and conveying the recording paper P one sheet at a time in cooperation with a separating pad 10 described later.

The feeding rollers 8 and 9, as well as other rollers, are rotatably disposed at prescribed positions on the main frame 1 and are driven to rotate by a common drive source that also drives the image-forming units 7. The separating pad 10 is supported in the paper cassette 3 by a spring 11. When the paper cassette 3 is inserted into the laser printer 100 to a prescribed position, the urging force of the spring 11 presses the separating pad 10 against the feeding roller 9.

The image-forming units 7Y, 7M, 7C, and 7K are disposed in the center region of the main frame 1 for forming images corresponding to the colors yellow, magenta, cyan, and black. Hereinafter, the letters Y, M, C, and K appended to indicate specific colors will be omitted from the image-forming units 7Y, 7M, 7C, and 7K unless a certain color is being specified. A pair of conveying rollers 13 for conveying the recording paper P and a pair of registration rollers 15 for registering and conveying the recording paper P are provided in the order given along the conveying path of the recording paper P leading from the feeding roller 9 to the image-forming units 7. The registration rollers 15 temporarily halt the sheet of recording paper P prior to the image-forming operation performed with the image-forming units 7, correct misalignment in the recording paper P by locking the leading edge of the recording paper P, and continue to convey the recording paper P toward the image-forming units 7.

A conveying belt 16 is disposed along the bottoms of the four image-forming units 7 for conveying the recording paper P that has passed through the registration rollers 15. As the conveying belt 16 conveys the recording paper P beneath the image-forming units 7, the image-forming units 7 form toner images in each color on the recording paper P. A manual feed slot 17 is formed in the lower side of the main frame 1, on which the paper cassette 3 is inserted and removed (hereinafter referred to as the "front side"), for manually feeding recording paper P into the laser printer 100. The recording paper P supplied through the manual feed slot 17 is conveyed to a nip point between the registration rollers 15 by a manual feeding roller 18. Next, the conveying belt 16 conveys the recording paper P as images are formed thereon.

Each of the image-forming units 7 includes a scanning unit 21, and a process unit 31. The scanning unit 21 is fixed to the body of the laser printer 100. The process unit 31 is detachably mounted in the body of the laser printer 100. The scanning unit 21 includes a polygon mirror 22, a reflecting mirror 23, and an fθ lens 24 that are all accommodated in a casing 26 for each image-forming unit 7. The scanning unit 21 also includes a laser diode (not shown) for emitting a laser beam L. The polygon mirror 22 reflects the laser beam L emitted from the laser diode so as to sequentially change the direction of the laser beam L along a prescribed surface. The reflecting mirror 23 reflects the laser beam L reflected from the polygon mirror 22 toward a photosensitive drum 33 described later disposed in the process unit 31. The fθ lens 24 is provided along the optical path of the laser beam L.

The casing 26 has an exposure opening 26*a* provided on the process unit 31 side to allow the laser beam L reflected as described above to pass through to the photosensitive drum 33. The reflecting mirror 23 is disposed near the top of the process unit 31 and is oriented to reflect the laser beam L at an angle of 15 degrees to the optical path of the laser beam L prior to reflection so that the laser beam L passes through the exposure opening 26*a*.

With this construction, the scanning unit 21 and process unit 31 can be disposed in close proximity to achieve an overall compact device. Further, since the laser beam L is scanned from a point near the top of the scanning unit 21 toward the photosensitive drum 33, it is possible to allocate a sufficiently long optical path of the laser beam L, thereby reducing the size of the fθ lens 24 and the like and further reducing the size of the laser printer 100. Further, since the laser beam L is scanned from a point near the top of the scanning unit 21, the exposure opening 26*a* can be provided above the center of the scanning unit 21. Accordingly, it is possible to prevent toner from contaminating optical components such as a protective glass covering the exposure opening 26*a*.

Each of the process units 31 includes the photosensitive drum 33, and a Scorotron charger 34. The photosensitive drums 33 are rotatably provided in opposition to transfer rollers 39 with the conveying belt 16 interposed therebetween. A photosensitive layer is formed on the surface of the photosensitive drum 33. A motor 65 (see FIG. 2) disposed on the main body of the laser printer 100 provides a driving force for rotating the photosensitive drums 33. The chargers 34 apply a uniform charge on the surface of the respective photosensitive drums 33. Each process unit 31 also includes a toner box 35 disposed above the photosensitive drum 33, a supply roller 37 disposed below the toner box 35, and a developer roller 38 that supplies toner to the surface of the photosensitive drum 33.

With this construction, the laser beam L emitted from the scanning unit 21 forms an electrostatic latent image on the surface of the photosensitive drum 33. Subsequently, the developer roller 38 supplies toner to the surface of the photosensitive drum 33 in order to develop the latent image. As the photosensitive drum 33 rotates opposite the transfer rollers 39, the transfer roller 39 applies a bias voltage to the toner that has developed the latent image on the photosensitive drum 33, causing the toner to be transferred onto the recording paper P being conveyed by the conveying belt 16. In this way, images in each of the colors, yellow, magenta, cyan, and black, are sequentially formed on the recording paper P.

After passing by the image-forming units 7, the recording paper P is conveyed to a fixing unit 41. The fixing unit 41 includes a heating roller 43 and a pressure roller 45 for fixing the toner formed on the recording paper P with heat as the recording paper P passes between the heating roller 43 and pressure roller 45. After the image has been fixed, the recording paper P is further conveyed by a pair of discharge rollers 51. The discharge rollers 51 discharge the recording paper P onto a discharge tray 52 provided on the top surface of the main frame 1. A cleaning roller 53 is also provided in contact with the bottom surface of the conveying belt 16 for recovering toner scattered from the photosensitive drums 33, and deposited on the surface of the conveying belt 16. Hinges 52*a* are provided below the discharge rollers 51, enabling the entire discharge tray 52 to be rotated upward about the hinges 52*a*. Hence, the discharge tray 52 can be opened and closed about the hinges 52*a*.

Next, a driving mechanism for driving the photosensitive drums 33 will be described with reference to FIGS. 2 through 5B.

Figure 2:
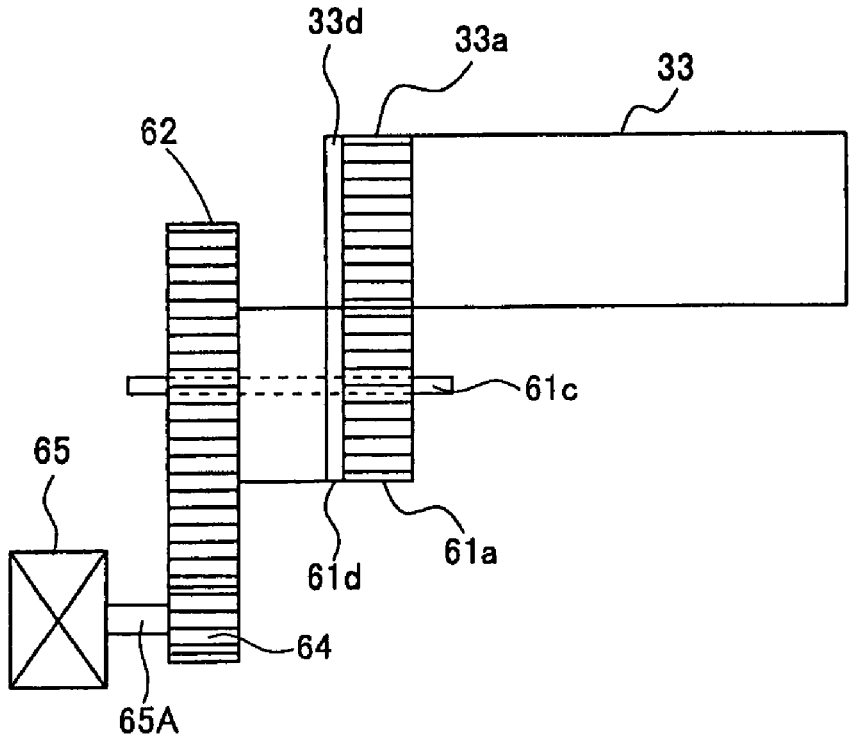
FIG. 2 is a schematic diagram showing a side surface of a drum gear and a drum drive gear according to the preferred embodiment.

As shown in FIG. 2, a drum gear 33*a* is provided on an axial end of the photosensitive drum 33. A drum gear rotating body 33*d* is disposed adjacent to the drum gear 33*a*, provided separately from the drum gear 33*a*, and assembled with the drum gear 33*a*. The drum gear rotating body 33*d* is shaped as a flat disc having substantially the same diameter as the drum gear 33*a*. The drum gear rotating body 33*d* rotates together with the drum gear 33*a*.

The motor 65 has an output shaft 65A. An output gear 64 is coaxially fixed to the end of the output shaft 65A. A central shaft 61*c* is rotatably supported inside the body of the laser printer 100. An intermediate gear 62 is coaxially fixed to one end of the central shaft 61*c* and engages with the output gear 64. A drum drive gear 61*a* is coaxially fixed to the other end of the central shaft 61*c* and is engaged with the drum gear 33*a*. The drum drive gear 61*a* has a diameter and a number of gear teeth equivalent to those of the drum gear 33*a*. Therefore, the drum gear 33*a* and drum drive gear 61*a* can rotate at uniform speeds in opposite rotational directions. Further, a drum drive gear rotating body 61*d* is provided adjacent to the drum drive gear 61*a* at a position on the central shaft 61*c* opposing to the drum gear rotating body 33*d*. The drum drive gear rotating body 61*d* has a flat disc shape with a diameter substantially equivalent to that of the drum drive gear 61*a* and rotates together with the drum drive gear 61*a*. The drum drive gear rotating body 61*d* is formed separately from the drum drive gear 61*a* and is assembled with the drum drive gear 61*a*.

The motor 65 drives the drum drive gear 61*a* to rotate. More specifically, when the motor 65 is driven, the output shaft 65A rotates, causing the output gear 64 to rotate. The rotation of the output gear 64 is transferred to the intermediate gear 62, causing the intermediate gear 62 to rotate. The rotation of the intermediate gear 62 rotates the drum drive gear 61*a*.

The drum drive gear 61*a* is engaged with the drum gear 33*a* and drives the drum gear 33*a*. Further, since the drum gear 33*a* and the drum gear rotating body 33*d* rotate together, the drum gear rotating body 33*d* is driven to rotate when the drum gear 33*a* is driven to rotate.

The drum gear 33*a* and drum drive gear 61*a* are engaged in the following way. Specifically, the photosensitive drum 33, on which the drum gear 33*a* is provided, is mounted together with the process unit 31 in the laser printer 100 along a guide groove (not shown) formed in the body of the laser printer 100. A spring (not shown) urges the drum gear 33*a* toward the drum drive gear 61*a*.

Figure 3:
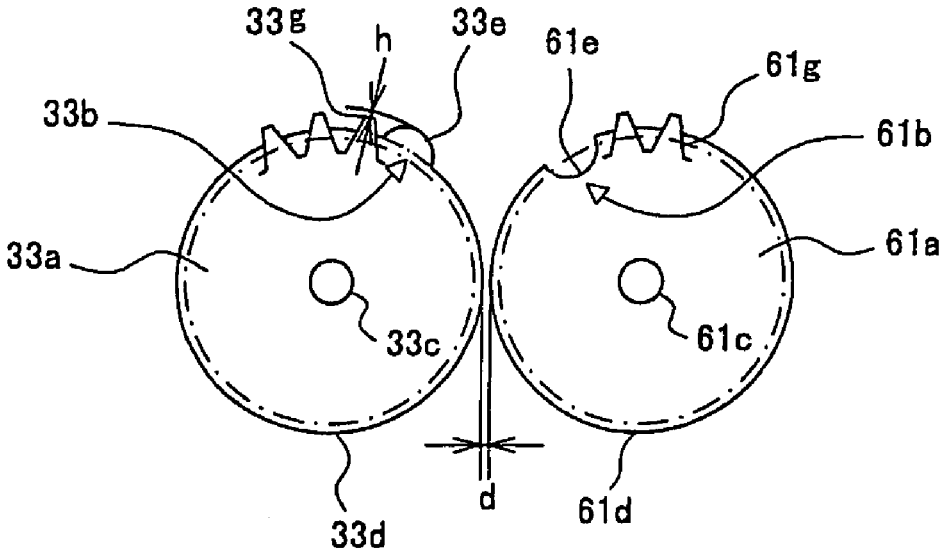
FIG. 3 is a schematic diagram showing the front view of a drum gear rotating body and a drum drive gear rotating body according to the preferred embodiment.

As shown in FIG. 3, the drum gear 33*a* rotates about a central axis 33*c*. A protrusion 33*e* substantially semicircular in shape is provided on a peripheral edge of the drum gear rotating body 33*d*. The drum gear 33*a* has gear teeth 33*g* formed around the peripheral edge thereof. The height of the protrusion 33*e* in the radial direction is larger than the height of the gear teeth 33*g* by a distance h. A point 33*b* on the drum gear 33*a* corresponding to the protrusion 33*e* is set to a position at which the protrusion 33*e* fits into a depression 61*e* described later for engaging the drum gear 33*a* with the drum drive gear 61*a* at a prescribed phase.

Similarly, the depression 61*e* having a substantially semicircular shape is formed in a periphery of the drum drive gear rotating body 61*d*. The depression 61*e* is formed at a size for fitting over the protrusion 33*e* provided on the periphery of the drum gear rotating body 33*d*. A point 61*b* on the drum drive gear 61*a* corresponding to the depression 61*e* is set a position in which the depression 61*e* fits over the protrusion 33*e* so that the drum drive gear 61*a* is engaged with the drum gear 33*a* at a prescribed phase.

With the construction described above, when the protrusion 33*e* of the drum gear rotating body 33*d* contacts the drum drive gear rotating body 61*d*, the drum gear 33*a* is moved in a direction away from the drum drive gear 61*a*. As a result, the drum gear 33*a* and drum drive gear 61*a* can be disengaged, thereby halting the rotation of the drum gear 33*a*. Hence, the drum drive gear 61*a* rotates while the drum gear 33*a* can wait in a halted state until the depression 61*e* of the drum drive gear rotating body 61*d* fits over the protrusion 33*e* of the drum gear rotating body 33*d*. This construction eliminates the need for a special control device or the like to halt the rotation of the drum gear 33*a*.

Further, when the drum gear 33*a* and drum drive gear 61*a* are in an engaged state, a gap d is formed between the drum gear rotating body 33*d* and drum drive gear rotating body 61*d* so that they do not contact one another. Since this gap d prevents the drum gear rotating body 33*d* and central shaft 61*c* from contacting one another when the drum gear 33*a* and drum drive gear 61*a* are engaged, this construction can prevent the generation of noise, vibrations, damage, and the like between the drum gear rotating body 33*d* and the drum drive gear rotating body 61*d*. Therefore, the engagement of the drum gear 33*a* and the drum drive gear 61*a* is not affected by the engagement of the protrusion 33*e* and the depression 61*e*.

Figure 4A:
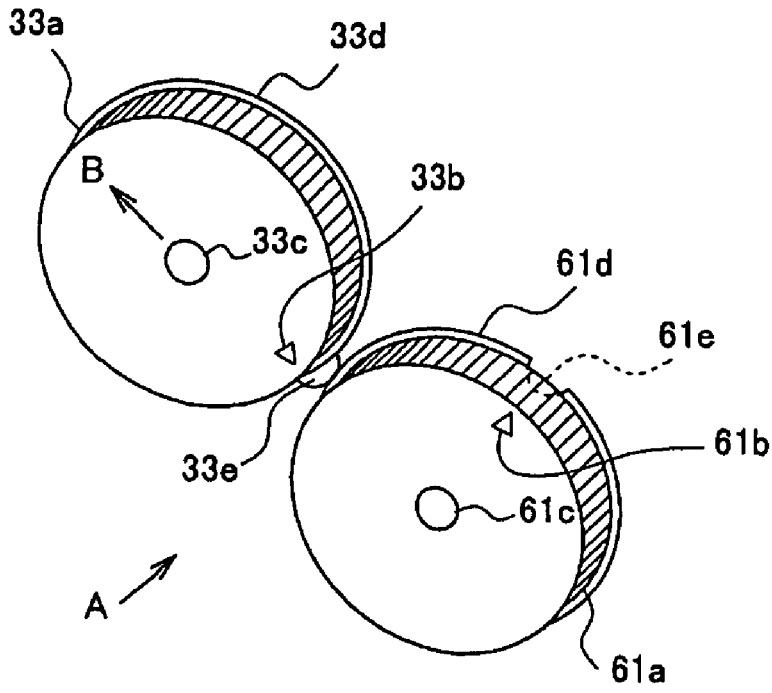
FIG. 4A is a perspective view showing the drum gear and drum drive gear of the preferred embodiment in a disengaged state.
Figure 4B:
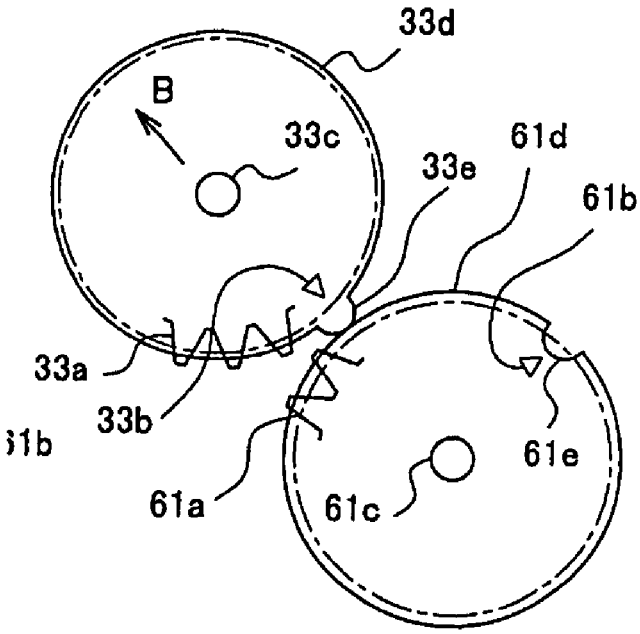
FIG. 4B is a front view of the drum gear and drum drive gear in the direction indicated by an arrow A in FIG. 4A.

FIGS. 4A and 4B show the drum gear 33*a* and the drum drive gear 61*a* in a disengaged state. When the protrusion 33*e* of the dram gear rotating body 33*d* contacts and rides up on the drum drive gear rotating body 61*d*, the central shaft 33*c* of the drum gear 33*a* moves in the direction indicated by the arrow B. As a result, the drum gear 33*a* disengages from the drum drive gear 61*a*. Since the driving force of the drum drive gear 61*a* is no longer transferred to the drum gear 33*a*, the drum gear 33*a* stops rotating.

Figure 5A:
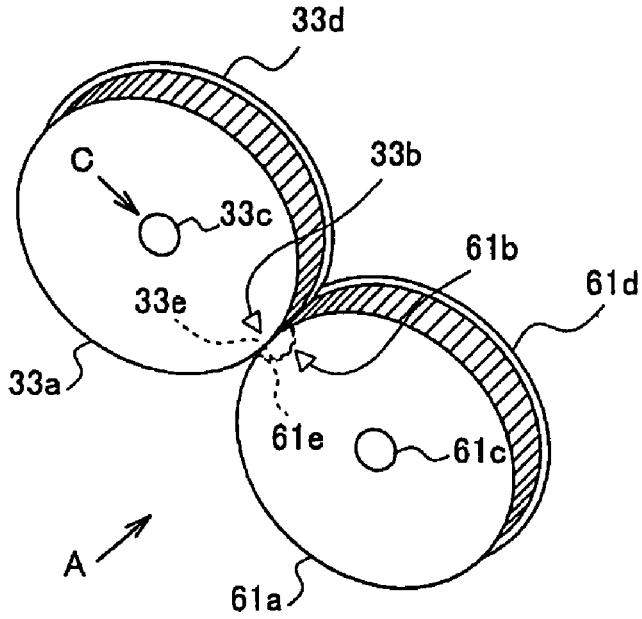
FIG. 5A is a perspective view showing the drum gear and drum drive gear of the preferred embodiment in an engaged state.
Figure 5B:
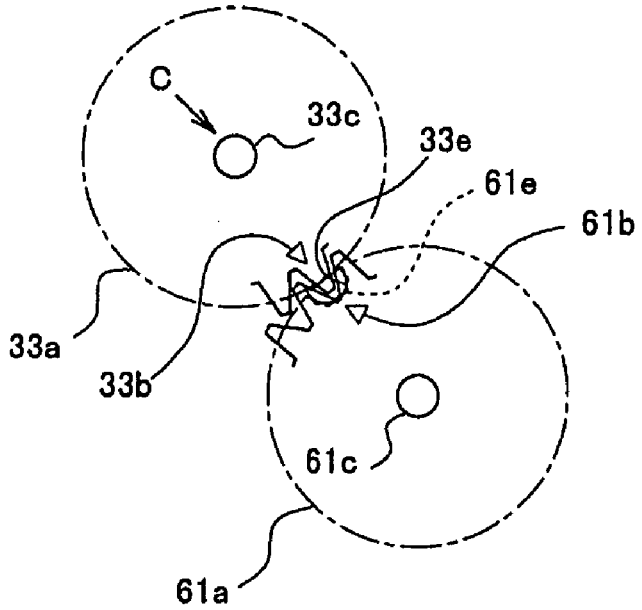
FIG. 5B is a front view of the drum gear and drum drive gear in the direction indicated by an arrow A in FIG. 5A.

FIGS. 5A and 5B show the drum gear 33*a* and the drum drive gear 61*a* in an engaged state.

When the protrusion 33*e* is fitted into the depression 61*e*, the central shaft 33*c* of the drum gear 33*a*, which was separated from the drum drive gear 61*a*, moves in a direction indicated by the arrow C, allowing the drum gear 33*a* to reengage with the drum drive gear 61*a*. Consequently, the driving force of the drum drive gear 61*a* is transferred to the drum gear 33*a*, causing the drum gear 33*a* to begin rotating again.

The protrusion 33*e* is formed on the drum gear rotating body 33*d* at the prescribed point (phase) 33*b* for engaging the drum gear 33*a* with the drum drive gear 61*a*. The depression 61*e* is also formed on the drum drive gear rotating body 61*d* at the prescribed point (phase) 61*b* for engaging the drum drive gear 61*a* with the drum gear 33*a*. Accordingly, the drum gear 33*a* and drum drive gear 61*a* are configured to engage at a prescribed phase when the protrusion 33*e* fits into the depression 61*e*.

Figure 6A:
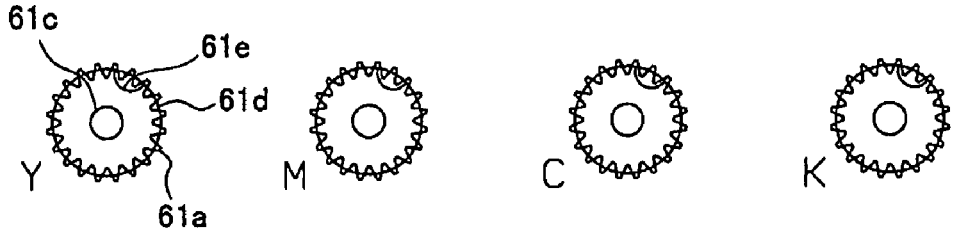
FIG. 6A is a schematic diagram showing drum drive gears according to the preferred embodiment that are capable of engaging with drum gears for the photosensitive drums of each toner color.

Next, the prescribed phase setting for the drum gear 33*a* and drum drive gear 61*a* will be described with reference to FIGS. 6A through 8B. In FIG. 6A, the process unit 31 for each toner color is not mounted in the body of the laser printer 100. Only the drum drive gears 61*a* are shown.

Figure 6B:
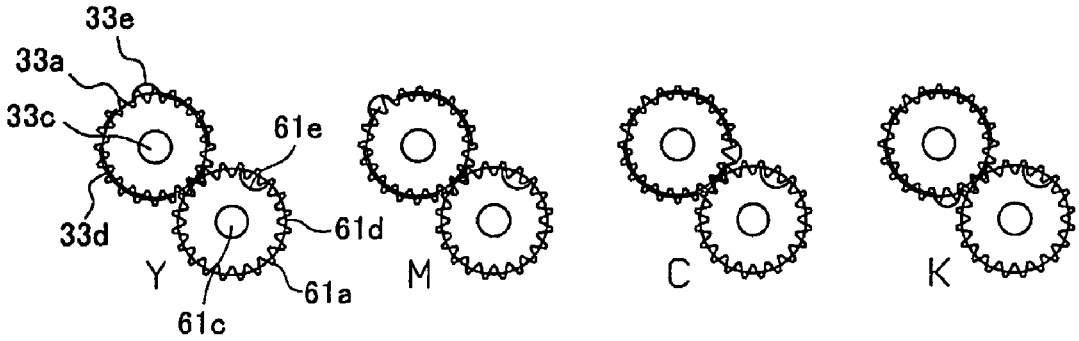
FIG. 6B is a schematic diagram showing the drum gears engaged with the drum drive gears when each process unit is mounted in the body of the color laser printer.

When the process units 31 for each toner color are mounted in the body of the laser printer 100, as shown in FIG. 6B, the drum gears 33*a* engage with the drum drive gears 61*a* and are driven to rotate by the drum drive gears 61*a*.

Figure 6C:
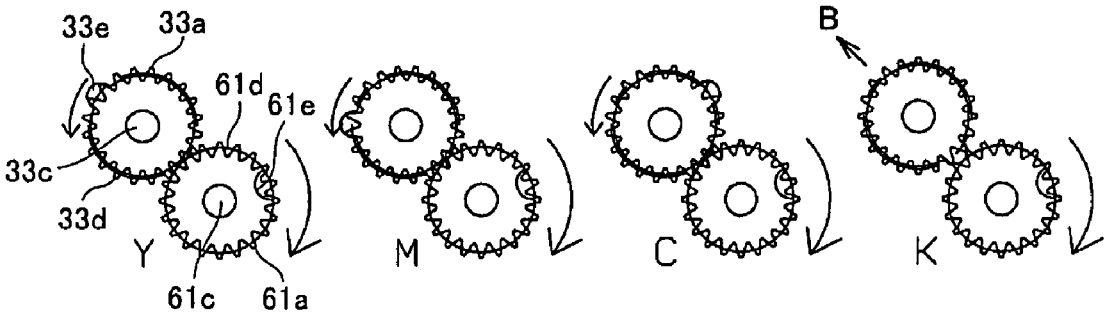
FIG. 6C is a schematic diagram showing the drum gears and the drum drive gears that have been rotated from the state shown in FIG. 6B, while a protrusion in the black (K) drum gear rotating body contacts and rides up on the drum drive gear rotating body and halts rotation of the black (K) drum gear.

In FIG. 6C, the protrusion 33*e* of the black (K) drum gear rotating body 33*d* contacts and rides up on the drum drive gear rotating body 61*d*, causing the central shaft 33*c* of the drum gear 33*a* to move in the B direction. Consequently, the drum gear 33*a* disengages from the drum drive gear 61*a*, halting the rotation of the drum gear 33*a*, which was previously driven by the drum drive gear 61*a*. This state corresponds to that shown in FIGS. 4A and 4B.

Figure 6D:
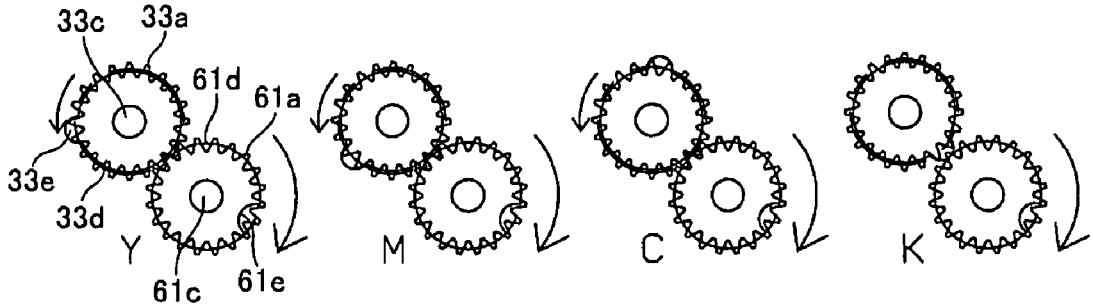
FIG. 6D is a schematic diagram showing the drum gears and drum drive gears for all colors except black (K) rotating in the same state shown in FIG. 6C.

In FIG. 6D, the black (K) drum gear 33*a* remains halted, while the drum gears 33*a* of the other colors remain engaged with the respective drum drive gears 61*a* and continue to be driven to rotate by the same.

Figure 7A:
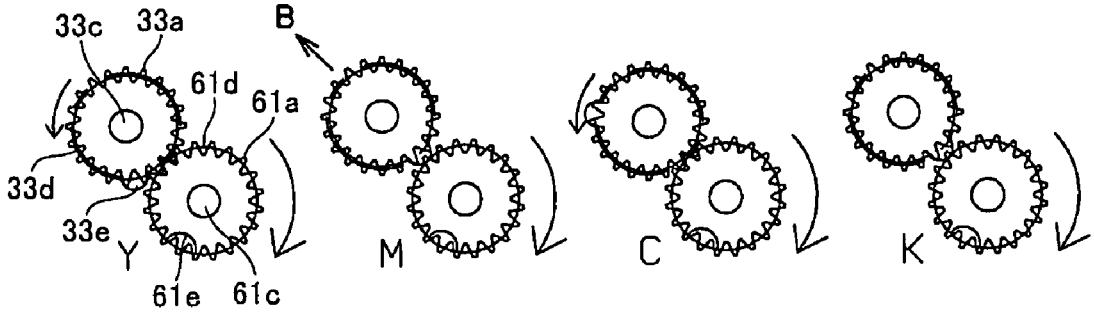
FIG. 7A is a schematic diagram showing the rotation of the drum gears and drum drive gears continuing from the state shown in FIG. 6D, wherein a protrusion on the magenta (M) drum gear rotating body contacts and rides up on the drum drive gear rotating body and halts the rotation of the magenta (M) drum gear.

In FIG. 7A, the protrusion 33*e* of the magenta (M) drum gear rotating body 33*d* contacts and rides up on the drum drive gear rotating body 61*d*, moving the central shaft 33*c* of the respective drum gear 33*a* in the B direction. Consequently, the drum gear 33*a* disengages from the drum drive gear 61*a* and stops rotating, as the drum gear 33*a* is no longer driven by the drum drive gear 61*a*.

Figure 7B:
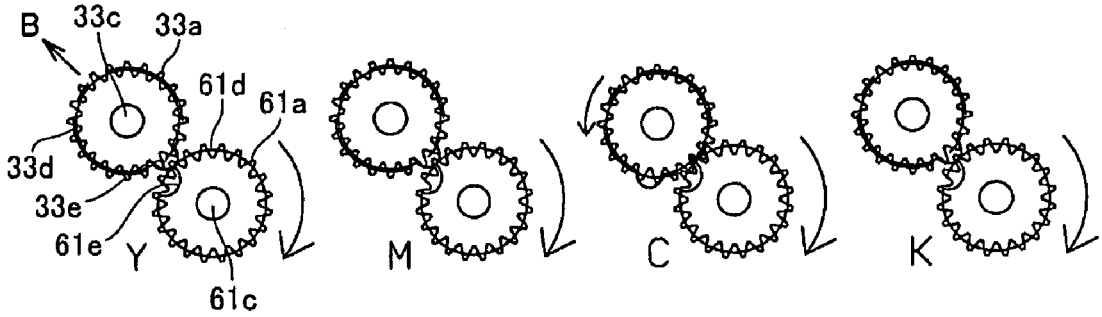
FIG. 7B is a schematic diagram showing the rotation of the drum gears and drum drive gears continuing from the state shown in FIG. 7A, wherein a protrusion on the yellow (Y) drum gear rotating body contacts and rides up on the drum drive gear rotating body and halts the rotation of the yellow (Y) drum gear.

In FIG. 7B, the protrusion 33*e* of the yellow (Y) drum gear rotating body 33*d* contacts and rides up on the drum drive gear rotating body 61*d*, moving the central shaft 33*c* of the respective drum gear 33*a* in the B direction. Consequently, the drum gear 33*a* disengages from the drum drive gear 61*a* and stops rotating, as the drum gear 33*a* is no longer driven by the drum drive gear 61*a*

Figure 7C:
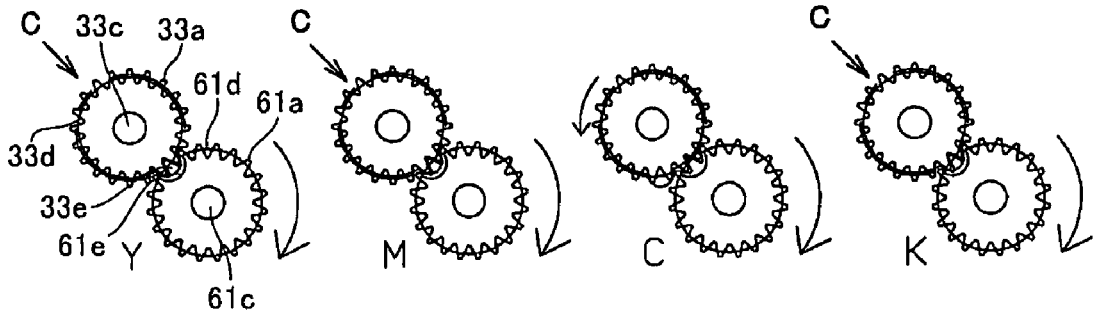
FIG. 7C is a schematic diagram showing the rotation of the drum gears and drum drive gears continuing from the state shown in FIG. 7B, wherein protrusions on the black (K), magenta (M), and yellow (Y) drum gear rotating bodies are fitted into depressions formed in the drum drive gear rotating bodies to re-engage the drum gears with the drum drive gears.

In FIG. 7C, the protrusion 33*e* formed on the drum gear rotating body 33*d* of the colors black (K), magenta (M), and yellow (Y) are fitted into the depression 61*e* of the respective drum drive gear rotating body 61*d*. At this time, the central axes 33*c* of the drum gears 33*a*, which have been separated from the drum drive gears 61*a*, move in the C direction so that the drum gears 33*a* reengage with the respective drum drive gears 61*a*. Consequently, the drum gears 33*a* for the colors black, magenta, and yellow begin being driven again by the respective drum drive gears 61*a*. This state corresponds to that shown in FIGS. 5A and 5B. As a result, the engaging positions of the drum gears 33*a* and drum drive gears 61*a* for black (K), magenta (M), and yellow (Y) are set to a prescribed phase.

Figure 7D:
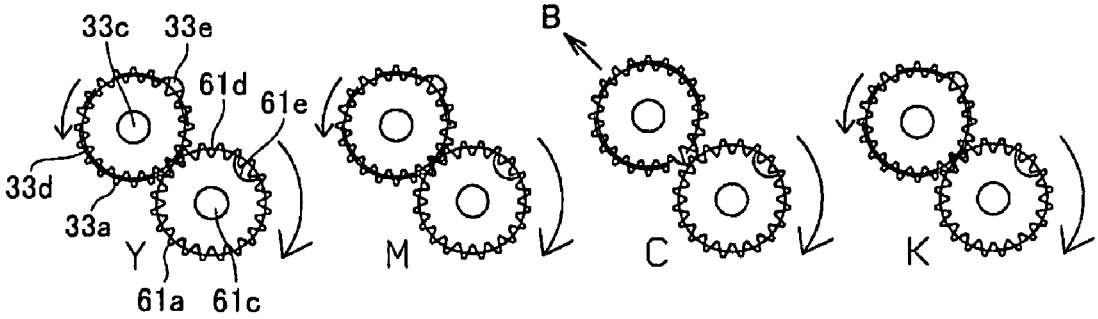
FIG. 7D is a schematic diagram showing the rotation of the drum gears and drum drive gears continuing from the state shown in FIG. 7C, wherein a protrusion formed on the cyan (C) drum gear rotating body contacts and rides up on the drum drive gear rotating body and halts the rotation of the cyan (C) drum gear.

In FIG. 7D, the protrusion 33*e* of the cyan (C) drum gear rotating body 33*d* contacts and rides up on the drum drive gear rotating body 61*d*, moving the central shaft 33*c* of the respective drum gear 33*a* in the B direction. Consequently, the drum gear 33*a* disengages from the drum drive gear 61*a* and stops rotating, as the drum gear 33*a* is no longer driven by the drum drive gear 61*a*.

Figure 8A:
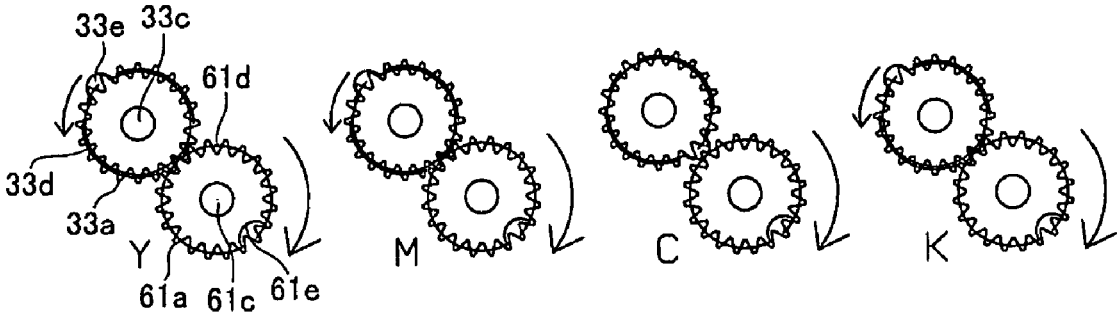
FIG. 8A is a schematic diagram showing the rotation of the drum gears and drum drive gears continuing from the state shown in FIG. 7D, wherein the drum gear and drum drive gear for each color except cyan (C) is rotating.

In FIG. 8A, the drum gears 33*a* for black (K), magenta (M), and yellow (Y) continue to rotate with the engaged position of the drum gears 33*a* and drum drive gears 61*a* set at the prescribed phase. However, the drum gear 33*a* for cyan (C) is halted.

Figure 8B:
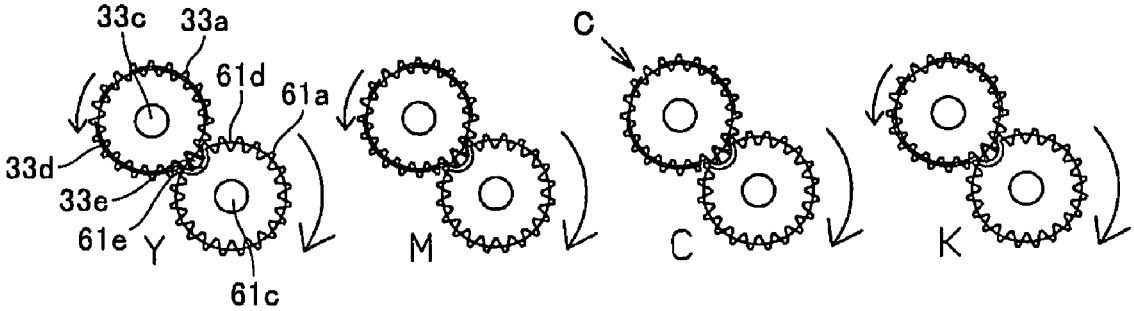
FIG. 8B is a schematic diagram showing the rotation of the drum gears and drum drive gears continuing from the state shown in FIG. 8A, wherein the protrusion formed on the cyan (C) drum gear rotating body fits into a depression formed in the drum drive gear rotating body so that the engagement between drum gears and drum drive gears for all colors yellow (Y), magenta (M), cyan (C), and black (K) are set to a prescribed phase.

When the protrusion 33*e* of the cyan (C) drum gear rotating body 33*d* fits into the depression 61*e* of the respective drum drive gear rotating body 61*d*, as shown in FIG. 8B, the central shaft 33*c* of the drum gear 33*a*, which has been separated from the drum drive gear 61*a*, moves in the C direction so that the drum gear 33*a* reengages with the drum drive gear 61*a*. Consequently, the drum gear 33*a* is once again driven to rotate by the drum drive gear 61*a*. In this way, the engagement between the drum gears 33*a* and drum drive gears 61*a* for all colors yellow (Y), magenta (M), cyan (C), and black (K) can be set automatically to a prescribed phase.

With this construction, the drum gears 33*a* and drum drive gears 61*a* can be set to engage at a prescribed phase by fitting the protrusions 33*e* of the drum gear rotating bodies 33*d* into the corresponding depressions 61*e* of the drum drive gear rotating bodies 61*d*. Setting the engagements to this prescribed phase can prevent errors in registration of images formed by each photosensitive drum 33, thereby improving image quality. Further, this construction eliminates the need for detecting means to detect the point 33*b* on the drum gear 33*a* and the point 61*b* on the drum drive gear 61*a*, and determining means for determining whether the drum gear 33*a* and drum drive gear 61*a* are in a prescribed phase based on detection signals received from the detecting means. Accordingly, the structure of the laser printer 100 can be simplified, reducing manufacturing costs.

Figure 9:
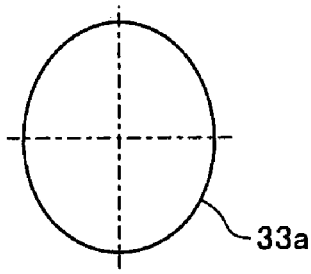
FIG. 9 is an explanatory diagram illustrating the peripheral shape of a drum gear according to the preferred embodiment.

Next, the effects obtained by setting the engagement of the drum gears 33*a* and drum drive gears 61*a* at a prescribed phase will be described with reference to FIGS. 9 through 12. FIG. 9 shows the general peripheral shape of the drum gear 33*a*.

Figure 10:
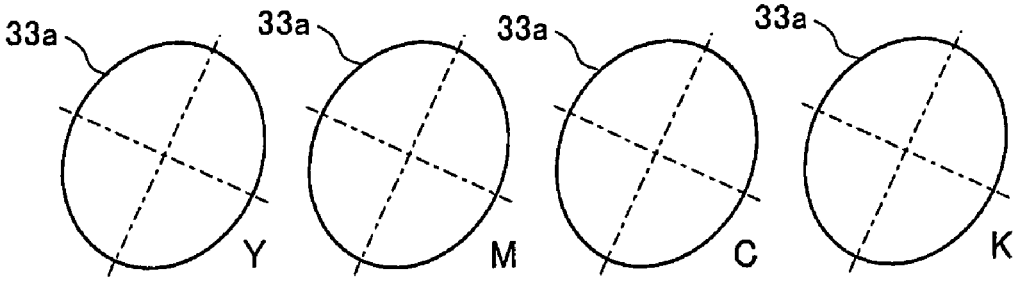
FIG. 10 is an explanatory diagram illustrating drum gears for colors cyan (C), yellow (Y), magenta (M), and black (K) that were formed using the same mold.

In this case, the mold for forming the drum gear 33*a* is slightly distorted. This distortion is transferred to the drum gear 33*a* during the molding process, as shown in FIG. 9. While not actually this great, the distortion in the general peripheral shape of the drum gear 33*a* has been exaggerated in FIG. 9 for explanatory purposes. The distortion of the drum gear 33*a* causes the photosensitive drum 33 to rotate unevenly. As shown in FIG. 10, the drum gears 33*a* for cyan (C), yellow (Y), magenta (M), and black (K) have been formed in the same mold and, hence, have the same distortion.

Figure 11:
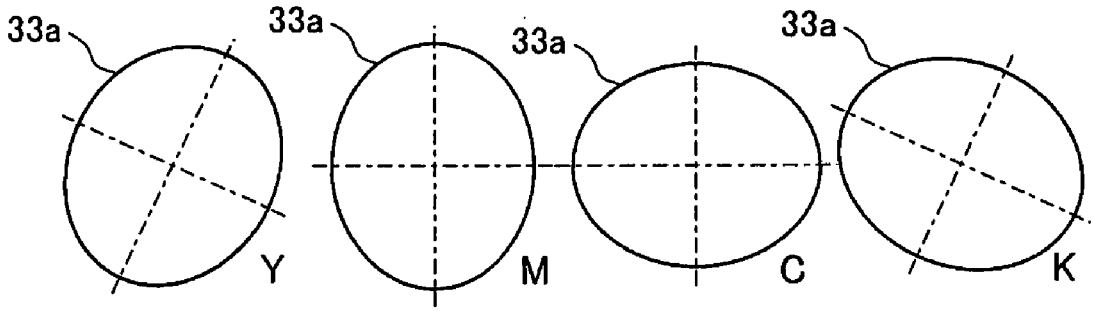
FIG. 11 is an explanatory diagram showing the drum gears of the preferred embodiment when phase is not considered.
Figure 12:
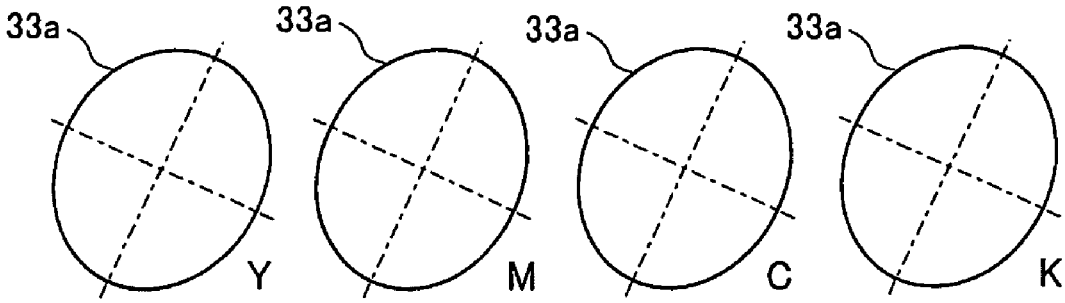
FIG. 12 is an explanatory diagram showing the drum gears according to the preferred embodiment when the phases are aligned.

If drum gears 33*a* having distortion such as these are engaged with drum drive gears 61*a* without consideration for the distortion (without considering the rotational angle (phase) of the drum gear 33*a*), the drum gears 33*a* may engage with the drum drive gears 61*a* as shown in FIG. 11. When the phase of the drum gears 33*a* is not the same for each color, the recording paper P may be conveyed irregularly between the photosensitive drums 33 of each color. As a result, toner images of each color transferred from the respective photosensitive drums 33 to the recording paper P may not be properly superimposed, resulting in misregistration.

However, the drum gears 33*a* according to the preferred embodiment described above can be automatically aligned in the same phase (see FIG. 12), aligning the irregular rotations of the drum gears 33*a*. This method can prevent the recording paper P from being conveyed irregularly between the photosensitive drums 33. Accordingly, this construction prevents registration problems for images formed by each photosensitive drum 33, thereby improving the image quality.

Further, since it is not necessary to integrate the photosensitive drums 33 of two or more colors, it is possible to replace the photosensitive drums 33 of any color independently as necessary, thereby reducing maintenance fees for the laser printer 100.

Further, this construction enables the photosensitive drum 33, drum gear 33*a*, and drum gear rotating body 33*d* to be supplied as an integrally assembled photosensitive drum unit.

While the invention has been described in detail with reference to specific embodiments thereof, it would be apparent to those skilled in the art that many modifications and variations may be made therein without departing from the spirit of the invention, the scope of which is defined by the attached claims. For example, in the preferred embodiment described above, the image-forming device is applied to a tandem-type color printer that transfers images directly onto the conveyed recording paper. However, the image-forming device of the present invention may also be applied to an intermediate transfer tandem-type color printer employing an intermediate transfer belt.

Figure 13:
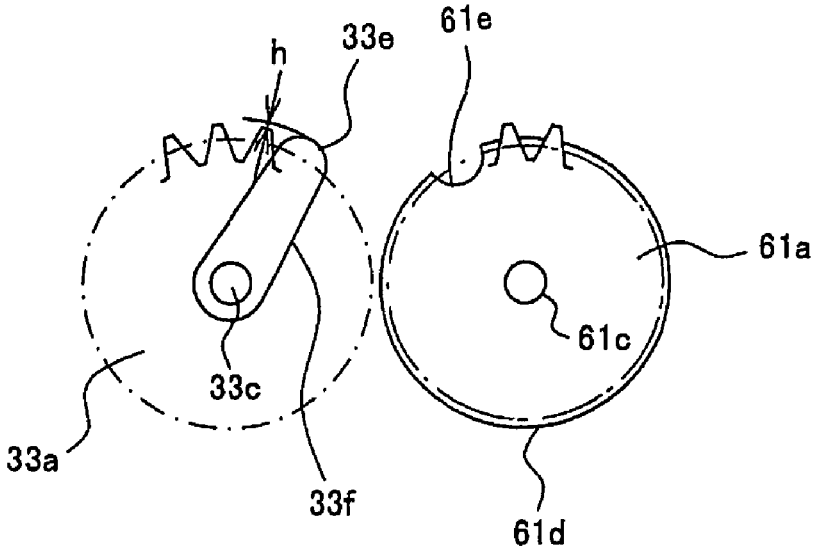
FIG. 13 is a schematic diagram showing the front view of a drum gear rotating body and a drum drive gear rotating body according to a variation of the preferred embodiment.

Further, in the preferred embodiment described above, the drum gear rotating body 33*d* is shaped as a flat disc having a diameter substantially equivalent to that of the drum gear 33*a*, as shown in FIG. 3. However, a flat rod-shape 33*f* such as that shown in FIG. 13 may be used instead.

Further, in the preferred embodiment described above, the central shaft 61*c* of the drum drive gear 61*a* is fixed, while the central shaft 33*c* of the drum gear 33*a* is capable of moving in the B direction. However, it is possible to fix the central shaft 33*c* of the drum gear 33*a* and enable the central shaft 61*c* of the drum drive gear 61*a* to move in a direction opposite to the B direction.

What is claimed is:

1. An image-forming device comprising:

an outer frame;

a plurality of photosensitive drums disposed inside the outer frame;

a drum gear provided on an axial end of each photosensitive drum and rotatable together with each photosensitive drum, the drum gear having gear teeth;

a drum gear rotating body that rotates together with the drum gear and has a peripheral surface provided with a protrusion;

a drum drive gear drivingly rotatably supported on the outer frame and meshedly engaged with the drum gear, the drum drive gear having the same number of gear teeth as the drum gear; and a drum drive gear rotating body rotatable together with the drum drive gear, the drum drive gear rotating body having a peripheral surface in alignment with the peripheral surface of the drum gear rotating body and formed with a depression engageable with the protrusion at a specific angular rotational phase of the drum gear and the drum drive gear, one of the drum gear and the drum drive gear being movable in a direction away from the other of the drum gear and the drum drive gear when the protrusion rides up on the peripheral surface other than the depression of the drum drive gear rotating body, to disengage the drum gear from the drum drive gear and to stop rotation of the drum gear at an angular rotational phase of the drum gear and the drum drive gear other than the specific angular rotational phase.

2. The image-forming device according to claim 1, wherein the protrusion has a height that enables the drum gear and drum drive gear to disengage from each other when the protrusion contacts the peripheral surface other than the depression of the drum drive gear rotating body.

3. The image-forming device according to claim 1, wherein the drum gear rotating body and the drum drive gear rotating body are separated from each other when the drum gear and drum drive gear are engaged and rotating.

4. The image-forming device according to claim 1, further comprising a scanning unit that scans and exposes the surface of each photosensitive drum to form an electrostatic latent image thereon, a developing unit that develops the latent images formed by the scanning unit on the photosensitive drums into a developer image by depositing developer of different colors on each photosensitive drum, and a transferring unit that transfers the developer image formed on the surface of each photosensitive drum by the developing unit onto a recording medium.

5. An image-forming device comprising:

an outer frame;

a plurality of photosensitive drums disposed inside the outer frame;

a drum gear provided on an axial end of each photosensitive drum and rotatable together with each photosensitive drum, the drum gear having gear teeth;

a drum gear rotating body that rotates together with the drum gear and has a peripheral surface provided with a protrusion;

a drum drive gear drivingly rotatably supported on the outer frame and meshedly engaged with the drum gear, the drum drive gear having the same number of gear teeth as the drum gear; and a drum drive gear rotating body rotatable together with the drum drive gear, the drum drive gear rotating body having a peripheral surface in alignment with the peripheral surface of the drum gear rotating body and formed with a depression engageable with the protrusion at a specific angular rotational phase of the drum gear and the drum drive gear.

6. A photosensitive drum unit provided in an image-forming device having a drum drive gear and a drum drive gear rotating body rotatable together with the drum drive gear and formed with a depression, the photosensitive drum unit comprising:

a plurality of photosensitive drums;

a drum gear provided on an axial end of each photosensitive drum and rotating together with each photosensitive drum, the drum gear being configured to meshedly engage with the drum drive gear; and a drum gear rotating body that rotates together with the drum gear and has a peripheral surface provided with a protrusion configured to engage with the depression of the drum drive gear rotating body.

7. A photosensitive drum unit installable in an image-forming device, comprising:

a plurality of photosensitive drums;

a drum gear provided on an axial end of each photosensitive drum and rotating together with each photosensitive drum; and a drum gear rotating body that rotates together with the drum gear and has a peripheral surface provided with a protrusion, wherein the drum gear further comprises gear teeth formed around the peripheral edge thereof, each of the gear teeth having a first height in a radial direction of the drum gear rotating body; and wherein the protrusion has a second height in the radial direction, the second height being greater than the first height of the gear teeth.

* * * * *